US007055324B2

(12) United States Patent
DePenning et al.

(10) Patent No.: US 7,055,324 B2
(45) Date of Patent: Jun. 6, 2006

(54) NOISE ABATEMENT DEVICE AND METHOD FOR AIR-COOLED CONDENSING SYSTEMS

(75) Inventors: Charles Lawrence DePenning, Nevada, IA (US); Frederick Wayne Catron, Marshalltown, IA (US); Allen Carl Fagerlund, Marshalltown, IA (US); Michael Wildie McCarty, Marshalltown, IA (US)

(73) Assignee: Fisher Controls International LLC, St. Louis, MO (US)

( * ) Notice: Subject to any disclaimer, the term of this patent is extended or adjusted under 35 U.S.C. 154(b) by 0 days.

(21) Appl. No.: 10/387,145

(22) Filed: Mar. 12, 2003

(65) Prior Publication Data

US 2004/0177613 A1 Sep. 16, 2004

(51) Int. Cl.
*F01K 13/02* (2006.01)

(52) U.S. Cl. ..... 60/646; 239/431; 366/107

(58) Field of Classification Search ..... 138/40; 239/431; 366/107; 60/646
See application file for complete search history.

(56) References Cited

U.S. PATENT DOCUMENTS

| | | | | |
|---|---|---|---|---|
| 3,220,710 | A | 11/1965 | Forster | |
| 3,785,779 | A * | 1/1974 | Li et al. | 422/231 |
| 4,903,491 | A | 2/1990 | Larinoff | 60/692 |
| 4,905,474 | A | 3/1990 | Larinoff | 60/692 |
| 5,338,496 | A | 8/1994 | Talbot et al. | |
| 6,095,196 | A | 8/2000 | McCarty et al. | 138/42 |
| 6,179,997 | B1 * | 1/2001 | Vedder et al. | 208/113 |
| 6,189,871 | B1 | 2/2001 | Schlageter et al. | |

FOREIGN PATENT DOCUMENTS

| | | |
|---|---|---|
| CH | 362093 | 5/1962 |
| DE | 1215731 | 5/1966 |

OTHER PUBLICATIONS

Severe Service Journal, Jul. 2001, vol. 3, Issue 6, Fisher Controls International, Inc., pp. 1-3.
Severe Service Journal, Nov. 2001, vol. 1, Issue 1, Fisher Controls International, Inc., pp. 1-3.
Servere Service Journal, Dec. 2002, vol. 2, Issue 4, Fisher Controls International Inc., pp. 1-2.
Turbine Bypass Condenser Dump Applications, Fisher Controls Product Bulletin, 85.1:020, Jul. 2002, pp. 1-8.
International Search Report for International Patent Application No. PCT/US04/006067, dated Sep. 17, 2004, 8 pages.
Written Opinion for International Application No. PCT/US04.006067, dated Sep. 17, 2004, 6 pages.

* cited by examiner

*Primary Examiner*—Harry B. Tanner
(74) *Attorney, Agent, or Firm*—Marshall, Gerstein Borun LLP

(57) ABSTRACT

A noise abatement device and method to direct flow in a predetermined manner to substantially reduce the aerodynamic noise and structural vibrations produced by steam entering an air-cooled condenser in a power generating system. The interactive flow between the spargers that produces the aerodynamic noise and structural vibrations is largely eliminated by prohibiting fluid flow through selected flow regions within the spargers. The spargers include a stack of disks with fluid passageways. The fluid passageways are interrupted with continuous and undivided regions of the sparger to direct radial flow away from adjacent spargers, substantially eliminating the interactive flow.

13 Claims, 9 Drawing Sheets

NOISE ABATEMENT DEVICE AND METHOD FOR AIR-COOLED CONDENSING SYSTEMS

TECHNICAL FIELD

The noise abatement device and method described herein makes known an apparatus and method for reducing noise in an air-cooled condensing system used in a power generating plant. More specifically, a fluid pressure reduction device is disclosed having an arrangement that significantly reduces the interaction flow occurring from a plurality of high velocity fluid jets exiting the fluid pressure reduction device.

BACKGROUND

Modern power generating stations or power plants use steam turbines to generate power. In a conventional power plant, steam generated in a boiler is fed to a turbine to where the steam expands as it turns the turbine to generate work to create electricity. Occasional maintenance and repair of the turbine system is required. During turbine maintenance periods or shutdown, the turbine is not operational. It is typically more economical to continue boiler operation during these maintenance periods, and as a result, the power plant is designed to allow the generated steam to continue circulation. In order to accommodate this design, the power plant commonly has supplemental piping and valves that circumvent the steam turbine and redirect the steam to a recovery circuit that reclaims the steam for further use. The supplemental piping is conventionally known as a Turbine Bypass.

In Turbine Bypass, steam that is routed away from the turbine must be recovered or returned to water. The recovery process allows that plant to conserve water and maintain a higher operating efficiency. An air-cooled condenser is often used to recover steam from the bypass loop and turbine-exhausted steam. To return the steam to water, a system must be designed to remove the heat of vaporization from the steam, thereby forcing it to condense. The air-cooled condenser facilitates heat removal by forcing low temperature air across a heat exchanger in which the steam circulates. The residual heat is transferred from the steam through the heat exchanger directly to the surrounding atmosphere. This recovery method is costly due to the expense of the air-cooled condenser. Consequently, certain design techniques are used to protect the air-cooled condenser.

One design consideration that must be addressed is the bypass steam's high operating pressure and high temperature. Because the bypass steam has not produced work through the turbine, its pressure and temperature is greater than the turbine-exhausted steam. As a result, bypass steam temperature and pressure must be conditioned or reduced prior to entering the air-cooled condenser to avoid damage. Cooling water is typically injected into the bypass steam to moderate the steam's temperature. The superheated bypass steam will generally consume the cooling water through evaporation as its temperature is lowered. However, this technique does not address the air-cooled condensers' pressure limitations. To control the steam pressure prior to entering the condenser, control valves and more specifically fluid pressure reductions devices, commonly referred to as spargers, are typically used. The spargers are aerodynamically restrictive devices that reduce pressure by transferring and absorbing fluid energy contained in the bypass steam. Typical spargers are constructed of a hollow housing which receives the bypass steam and a multitude of ports along the hollow walls of the housing providing fluid passageways to the exterior surface. By dividing the incoming fluid into progressively smaller, high velocity fluid jets, the sparger reduces the flow and the pressure of the incoming bypass steam and any residual spray water within acceptable limits prior to entering the air-cooled condenser.

Typical turbine bypass applications dump the bypass steam and residual spray water directly into large condenser ducts that feed the air-cooled condenser. In the process of reducing the incoming steam pressure, the spargers transfer the potential energy stored in the steam to kinetic energy. The kinetic energy generates turbulent fluid flow that creates unwanted physical vibrations in surrounding structures and undesirable aerodynamic noise. Additionally, the fluid jets, consisting of high velocity steam and residual spray water jets, exiting spargers can interact to substantially increase the aerodynamic noise.

SUMMARY

Accordingly, it is the object of the present noise abatement device and method to reduce aerodynamic noise and structural vibrations generated from turbine bypass applications and more specifically to substantially eliminate the interactive flow resulting from the high velocity fluid jets that would otherwise occur between spargers.

In accordance with one aspect of the present noise abatement device, a sparger comprises a housing having a hollow center extending along its longitudinal axis containing a plurality of fluid passageways. The passageways provide fluid communication with a plurality of inlets at the hollow center and a plurality of exterior outlets and are designed to substantially reduce the fluid pressure between the plurality of inlets and outlets. Additionally, a blocking sector is provided to direct fluid exiting the outlets in a predetermined manner to substantially reduce interactive flow that would otherwise be generated by fluid exiting the outlets.

In accordance with another aspect of the present noise abatement device, a sparger is assembled from stacked disks along a longitudinal axis that define the flow passages connecting the plurality of inlets to the exterior outlets. The stacked disks create restrictive passageways to induce axial mixing of the fluid to decrease fluid pressure that subsequently reduces the aerodynamic noise within the sparger. Further, the disks are modified to direct flow in a predetermined manner through the passageways to substantially reduce the interactive flow of high velocity fluid jets.

In accordance with another aspect of the present noise abatement device, a sparger is fashioned from a stack of disks with tortuous paths positioned in the top surface of each disk and are assembled to create fluid passageways between the inlet and outlets of the sparger. The tortuous paths permit fluid flow through the spargers and produce a reduction in fluid pressure. The disks are further designed to substantially eliminate interactive flow between spargers.

In a further embodiment, a typical sparger is retrofitted with a shield that substantially eliminates the interactive flow between multiple spargers.

In accordance with another aspect of the present sparger, a noise abatement device is created from multiple spargers, wherein the spargers are designed to essentially eliminate the radial flow between the spargers, thereby substantially reducing the aerodynamic noise generated by the interactive flow of high velocity fluid jets.

In another embodiment, a method to substantially reduce aerodynamic and structural noise within an air-cooled condenser is established.

BRIEF DESCRIPTION OF THE DRAWINGS

The features of this noise abatement device are believed to be novel and are set forth with particularity in the appended claims. The present noise abatement device may be best understood by reference to the following description taken in conjunction with the accompanying drawings in which like reference numerals identify like elements in the several figures and in which:

DETAILED DESCRIPTION

To fully appreciate the advantages of the present sparger and noise abatement device, it is necessary to have a basic understanding of the operating principles of a power plant and specifically, the operation of the closed water-steam circuit within the power plant. In power plants, recycling and conserving the boiler water significantly reduces the power plant's water consumption. This is particularly important since many municipalities located in arid climates require power plants to reduce water consumption.

Figure 1:
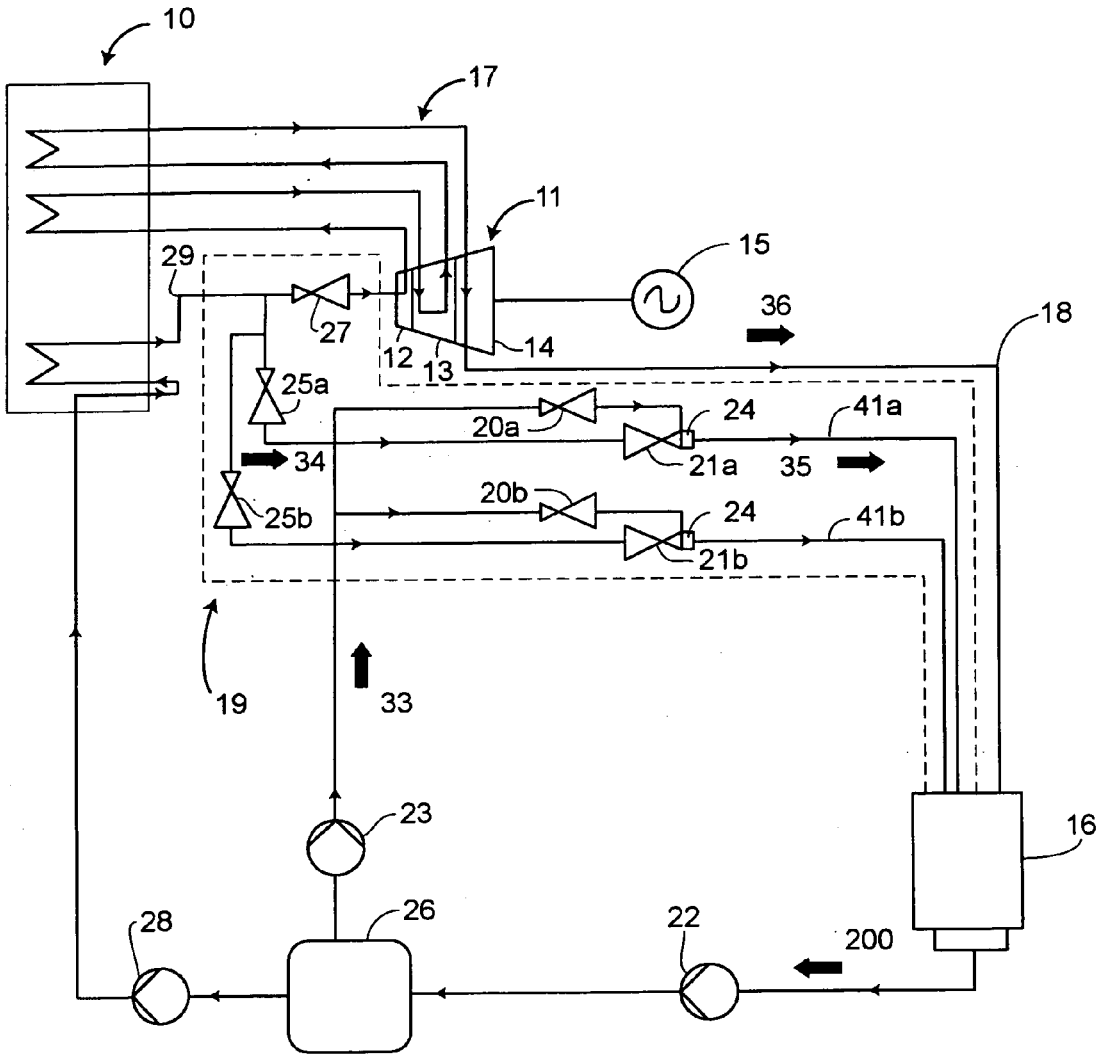
FIG. 1 is a block diagram depicting a steam turbine bypass loop in a typical power generating station.

Turning to the drawings and referring initially to FIG. 1, a block diagram of a steam turbine bypass loop of a power generating station is illustrated. The power generation process begins at the boiler 10. Energy conversion in the boiler 10 generates heat. The heat transforms the water pumped from a feedwater tank 26, using a feedwater pump 28, into steam. The feedwater tank 26 serves as the reservoir for the water-steam circuit. A series of steam lines or pipes 17 directs the steam from the boiler 10 to drive a steam turbine 11 for power generation. A rotating shaft (not shown) in the steam turbine 11 is connected to a generator 15. As the generator 15 turns, electricity is produced. The turbine-exhausted steam 36 from the steam turbine 11 is transferred through a steam line 18 to an air-cooled condenser 16 where the steam is converted back to water. The recovered water 200 is pumped by the condensate pump 22 back to the feedwater tank 26, thus completing the closed water-steam circuit for the turbine-exhausted steam 36.

Most modern steam turbines employ a multi-stage design to improve the plant's operating efficiency. As the steam is used to do work, such as to turn the steam turbine 11, its temperature and pressure decrease. The steam turbine 11 depicted in FIG. 1 has three progressive stages: a High-Pressure (HP) stage 12, an Intermediate-Pressure (IP) stage 13, and a Low-Pressure (LP) stage 14. Each progressive turbine stage is designed to use the steam with decreasing temperature and pressure. Therefore, the multi-stage steam turbines perform an important function in the water-steam circuit by decreasing steam pressure and temperature prior to recovery within the air-cooled condenser 16. However, the steam turbine 11 is not always operational. For economic reasons, the boiler is rarely shutdown. Therefore, another means to condition the steam must be available when the steam turbine 11 is not available. A turbine bypass loop 19 is typically used to accomplish this function.

During various operational stages with the plant such as startup and turbine shutdown, the steam turbine loop described above, is circumvented by a turbine bypass loop 19, as illustrated in FIG. 1. Numerous bypass schemes are typically employed in a power plant. Depending on the origin of the steam, whether it is from the HP stage or IP stage, and the operational stage of the plant, different techniques are required to moderate the steam prior to entering the air-cooled condenser 16. The HP bypass scheme illustrated in FIG. 1 is employed during turbine shutdown and adequately illustrates the operating conditions that require the present noise abatement device. During HP bypass, the turbine bypass loop 19 receives steam from the piping 29 that supplies steam to the HP stage 12 of the steam turbine 11, thus bypassing the steam turbine 11. For example, during these maintenance periods, the HP inlet valve 27 is operated in opposite fashion of the block valves 25*a–b* to shift steam from the steam turbine 11 directly to the turbine bypass loop 19. Bypass steam 34 entering the turbine bypass loop 19 in HP bypass is typically at a higher temperature and higher pressure than the air-cooled condenser 16 is designed to accommodate. Bypass valves 21*a–b* are used to take the initial pressure drop from the bypass steam 34. As understood by those skilled in the art, multiple bypass lines generally feed parallel bypass valve 21*a–b* to accommodate the back pressure required by the steam turbine 11. Alternate applications may require a single bypass line or can supplement the parallel bypass system depicted in FIG. 1 as the steam turbine 11 would dictate. Typically, the bypass steam pressure is reduced from several hundred psi to approximately fifty psi. To moderate the temperature of the bypass steam 34 exiting the boiler, spray water valves 20*a–b* receive spray water 33 from the spray water pump 23. The spray water 33 is injected into a desuperheater 24 where the lower temperature spray water 33 is mixed into the bypass steam 34 to reduce its temperature in the range of several hundred degrees Fahrenheit. In the process of reducing the temperature of the bypass steam 34, the spray water 33 is almost entirely consumed through evaporation. The conditioned steam 35 is inserted into the air-cooled condenser 16 through piping 41*a–b*, thus completing the fluid path of turbine bypass loop 19.

Figure 2A:
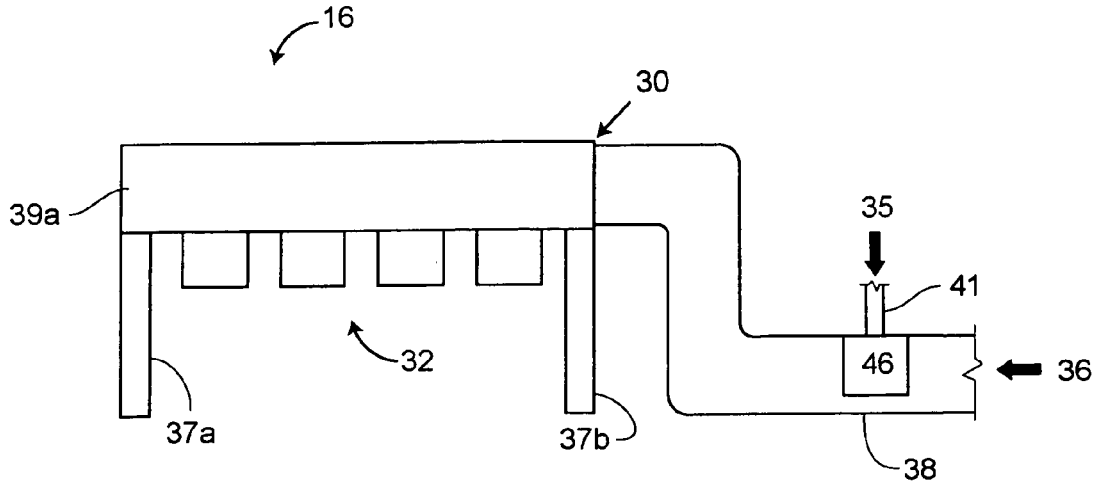
FIG. 2A is an illustrative side view of an air-cooled condenser used in the bypass loop of FIG. 1.
Figure 2B:
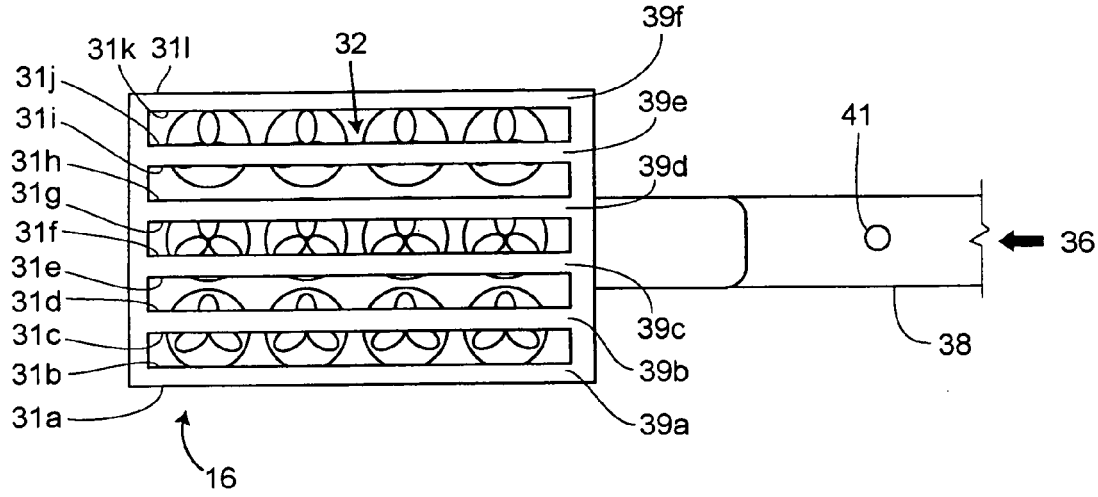
FIG. 2B shows a top view of the air-cooled condenser of FIG. 2A.

Referring now to FIGS. 2A and 2B, the structural components of the air-cooled condenser 16 are explained. In the air-cooled condenser 16, steam is routed through the steam line 41 to a condenser duct 38 and then to the heat exchanger 30. As previously described, the heat exchanger 30 functions like a typical radiator. That is, in a typical radiator, steam is circulated through chambers within the radiator. The heat from the steam is conducted through the walls of the chambers and radiated to the surrounding atmosphere. In the air-cooled condenser, turbine-exhausted steam 36 enters the heat exchanger 30 directly through the condenser duct 38. Conditioned steam 35 is feed into the condenser duct 38 (shown in detail in FIG. 3) via noise abatement device 46 from steam line 41 as it exits the turbine bypass loop 19 from the desuperheater 24 referenced in FIG. 1. The condenser duct 38 directly connects to the heat exchanger chambers 39*a–f*. As steam is circulated through the chambers 39*a–f*, the steam's heat is conducted to the chamber walls 31*a–l*. Further, the heat exchanger 30 is elevated upon supports 37*a–b* to provide adequate heat transfer for condensation. Steam condensation is achieved by forcing high velocity, low temperature air across the heat exchanger 30 by a fan array 32, which then carries the residual heat from the chamber walls 31*a–l* to the surrounding atmosphere. As illustrated and described in FIG. 1, the heat exchanger will receive steam from multiple sources, either conditioned steam 35 or turbine-exhausted steam 36, independently. In HP bypass, as depicted in FIG. 1, the valves 25 and 27 are operated in such a manner that in the present embodiment the turbine-exhausted steam 36 and the conditioned steam 35 are not flowing to the heat exchanger 30 simultaneously, but, as understood by those skilled in the art, this description is not intended to be limiting to the noise abatement device described herein.

Figure 3:
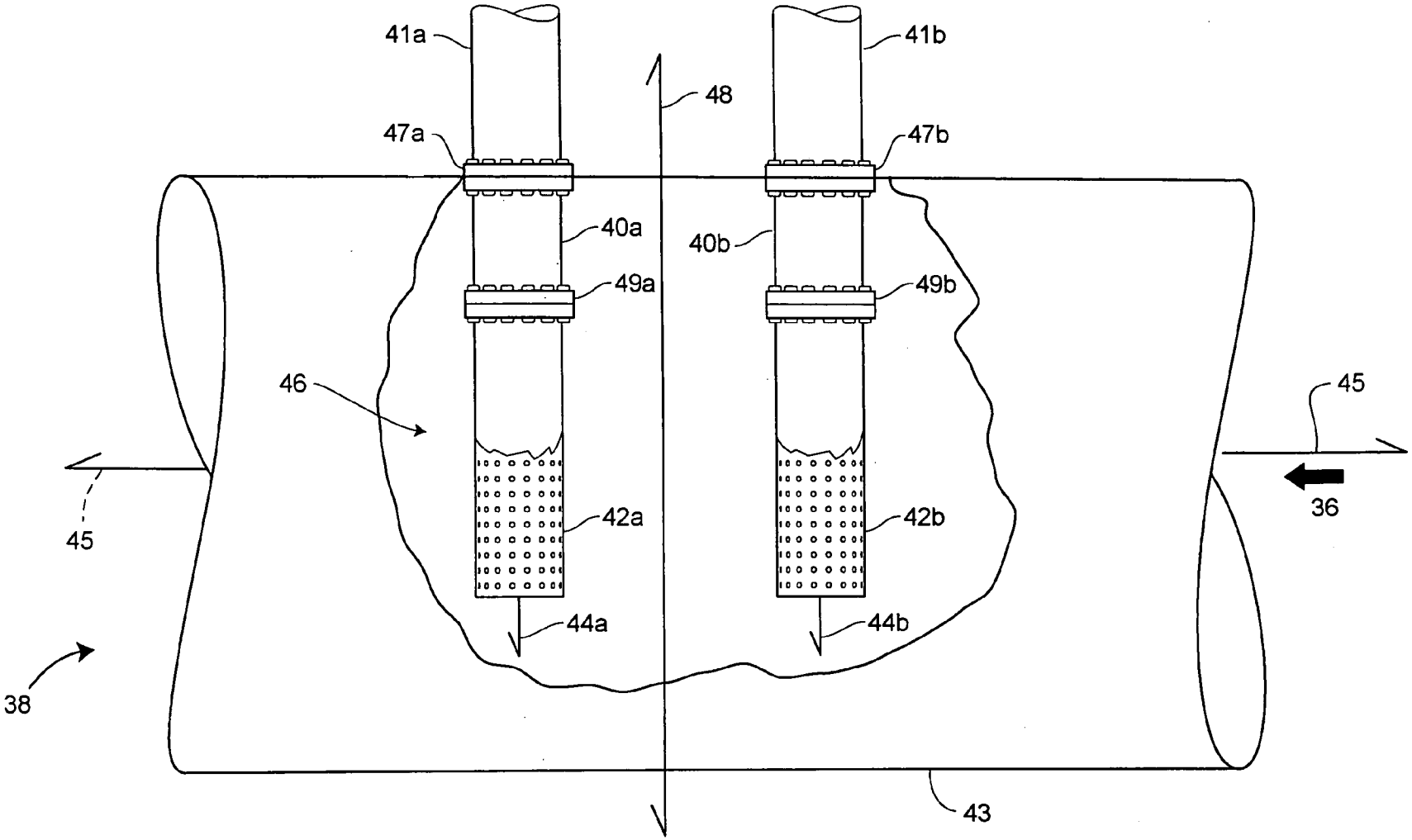
FIG. 3 is a partial sectioned side view illustrating the proximate positioning of parallel spargers within a condenser duct of an air-cooled condenser.

Depicted in FIG. 3, a partial sectioned side view illustrates noise abatement device 46 positioned inside the condenser duct 38. The noise abatement device 46 includes parallel spargers 42*a–b* positioned within the condenser duct 38. As explained in greater detail below, the spargers 42*a–b* create the final pressure drop required by the air-cooled condenser 16 by splitting the flow of the incoming fluid into many small jets through a plurality of passageways about the periphery of the spargers 42*a–b*. Radial flow from the spargers 42*a–b* can interact along the condenser duct wall 43 and can create an interactive flow about the central axis 48 of noise abatement device 46 between the spargers 42*a–b* causing excessive aerodynamic noise. The position and spacing of the spargers 42*a–b* impact the aerodynamic characteristics of the air-cooled condenser 16.

In the preferred noise abatement device 46, the spargers 42*a–b* are approximately parallel along their respective longitudinal axis 44*a* and 44*b* and symmetrically positioned about the central axis 48 of the noise abatement device 46. The parallel spargers 42*a–b* are preferably placed perpendicular to longitudinal axis 45 of the condenser duct 38 to reduce their cross-sectional area within the condenser duct 38, thereby limiting the fluidic restriction and back pressure experienced by the steam turbine 11 during operation. The bypass steam 34, which has been mixed with spray water 33 at the desuperheater 24 (FIG. 1), enters the condenser duct 38 through steam lines 41*a–b*. As depicted in FIG. 3, each sparger 42*a–b* placed within the condenser duct 38 has an individual penetration. The individual penetrations limit the piping and supporting structure within the condenser duct 38. In doing so, the cross-sectional area of the noise abatement device 46 is reduced to further minimize the fluidic restriction experienced by the steam turbine 11. As understood by those skilled in the art, other attachment or assembly methods can be envision without departing from the noise abatement device 46 as shown.

Continuing, flanges 47*a–b* are used to seal the condenser duct 38 at the penetration points of the noise abatement device 46. The parallel spargers 42*a–b* are connected through conventional piping techniques using a flanges 49*a–b* and pipes 40*a–b* as illustrated in FIG. 3. The condenser duct wall 43 of the condenser duct 38 is typically thin (about 0.5 inches) relative to the condenser duct 38 diameter (approximately 23 feet), making it a potentially resonant structure.

As described herein, the pressure of the reduced bypass steam 34 is typically in the range of 50 psi. During shutdown (depicted schematically in FIG. 1), the pressure within the condenser duct 38 is essentially atmospheric pressure, therefore the pressure drop across the spargers 42*a–b* is approximately 50 psi. Conversely, during start-up when the turbine is running, the condenser duct 38 will operate at a vacuum, due to the high velocity turbine exhaust, and create differential pressures across the spargers in excess of 50 psi. At these pressure ranges, fluid velocities are sufficient to create substantial noise when the fluid strikes the condenser duct wall 43. As understood by those skilled in the art, mechanical potential energy is stored in pressurized fluids. As the fluid pressure is lowered through a restrictive passageway, the potential energy is converted to kinetic energy in the form of turbulent fluid motion. FIGS. 4A–4D model the aerodynamic phenomena at the outer surface of the spargers 42*a–b* as the fluid progressively experiences increasing differential pressure.

In an air-cooled condenser system, turbulent fluid motion can create aerodynamic conditions that induce physical vibration and noise with such magnitude as to exceed governmental safety regulations and damage the steam recovery system. Therefore, it is desirable to develop a device and/or a method to substantially reduce these harmful effects. This potentially harmful aerodynamic phenomena can generally be reduced in any one of four ways: reduce the pressure in small stages, maintain fluidic separation to avoid turbulent recombination, prevent fluid contact with solid structures, and any combination of the previous three methods. The orifice plate section 50 depicted in FIGS. 4A–4D models the aerodynamic characteristics of individual fluid jets exiting the outer surface of the spargers 42*a–b* as the bypass steam 34 and spray water 20 are driven through the devices.

Figure 4B:
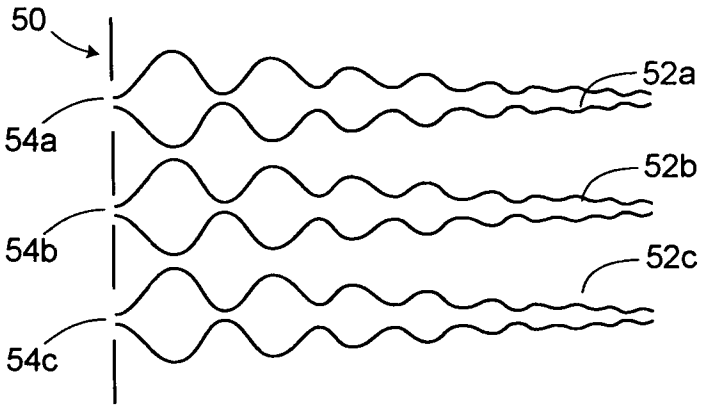
FIG. 4B is an illustrative view the orifice plate of FIG. 4A wherein the fluid jets exhibit decreasing individual separation at a pressure of p2.
Figure 4D:
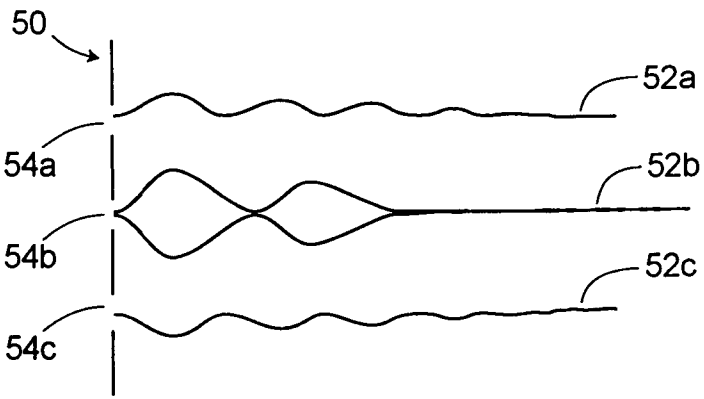
FIG. 4D is an illustrative view the orifice plate of FIG. 4A wherein the fluid jets exhibit extensive recombination at a pressure of p4.
Figure 4A:
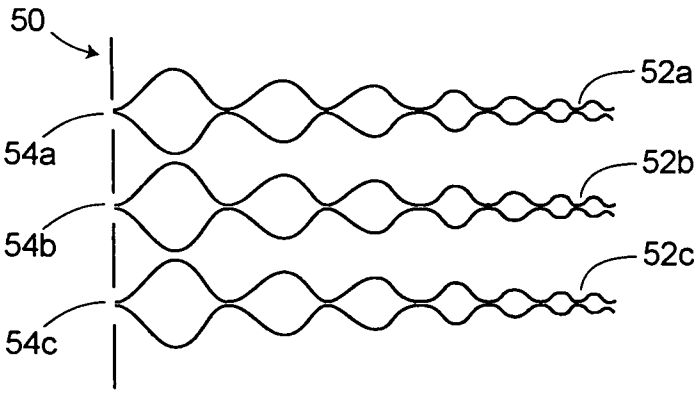
FIG. 4A is an illustrative view of fluid jets exiting an orifice plate containing a plurality of outlets wherein the fluid jets exhibit individual separation at a pressure of p1.
Figure 4C:
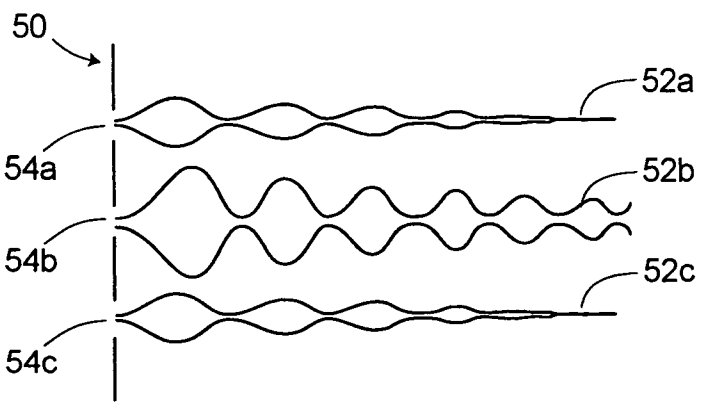
FIG. 4C is an illustrative view the orifice plate of FIG. 4A wherein the fluid jets exhibit slight recombination at a pressure of p3.

In FIGS. 4A–4D, the relative pressure across the orifice plate 50 is increased from p1 through p4, respectively. The fluid jets 52*a–c* exiting the orifice plate 50 in FIG. 4A show discrete separation of the fluid jets at the lowest pressure, p1. The discrete separation of the fluid jets 52*a–c* depicted in FIG. 4A produces relatively high frequency noise that is easily attenuated within the condenser duct 38. FIG. 4B shows a slight recombination of the jets 52*a–c* at the exit ports 54*a–c* on the orifice plate 50 when the pressure is increased to p2. As the driving pressure is further increased to p3, illustrated in FIG. 4C, a resonance of the fluid molecules begins to occur along the central jet 52*b* producing more extensive jet recombination. Lastly, illustrated in FIG. 4D, the pressure is increased to p4 and excessive jet recombination has occurred. The excessive jet reformation depicted in FIG. 4D creates substantially lower frequency noise than the noise generated by discrete jet separation depicted in FIG. 4A. The lower frequency noise can induce damaging structural resonance or vibration within the condenser duct 38. During operation of the bypass loop, a similar aerodynamic phenomena can result from prior art noise abatement device(s) 46 operating inside the condenser duct 38. Due to the harmful nature of the lower frequencies, it is desirable to eliminate them. The present noise abatement device, as claimed, directly addresses these issues.

Figure 5A:
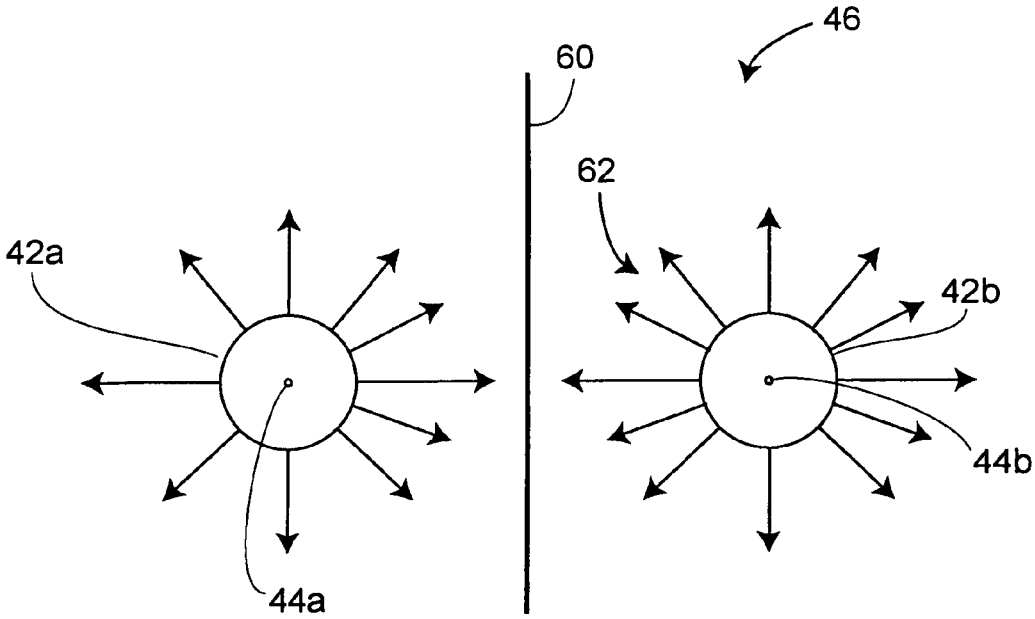
FIG. 5A is an illustrative top view of a typical noise abatement device using parallel spargers depicting the interaction zone attributable to converging radial flow between the spargers.
Figure 5B:
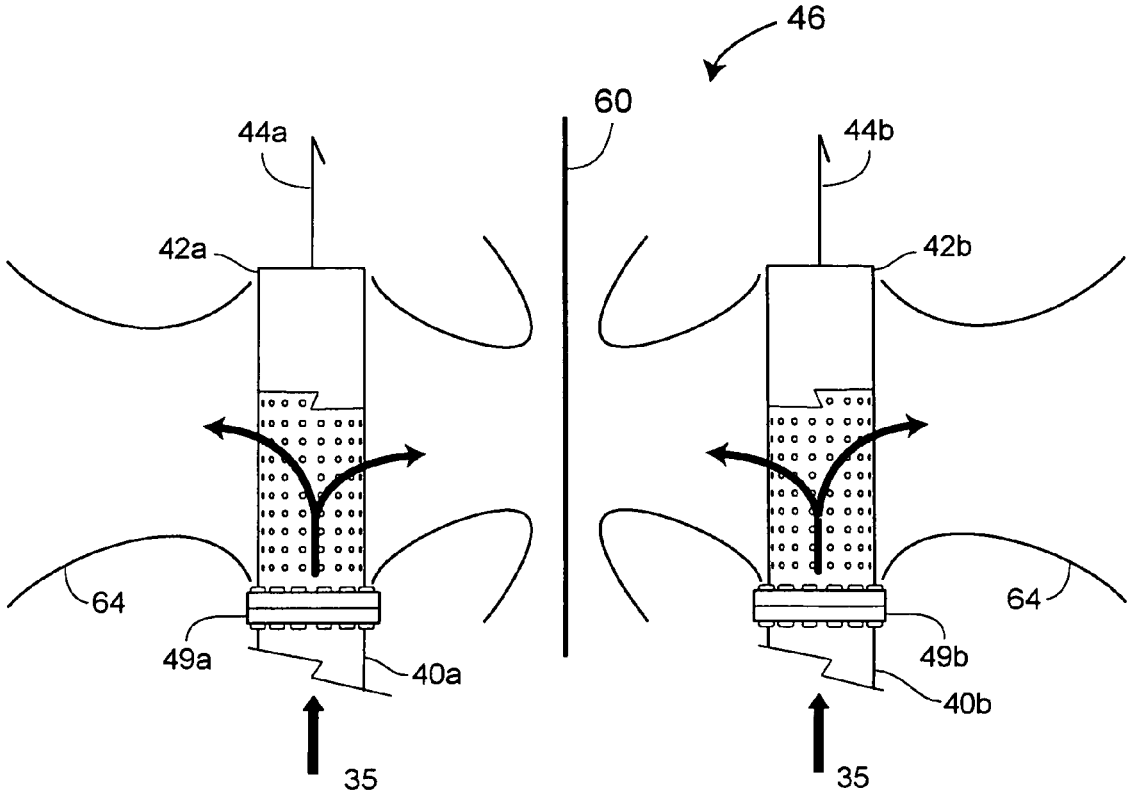
FIG. 5B is an illustrative side view of the parallel spargers of FIG. 5A showing the dissipative flow regions of the spargers.

Referring now to FIG. 5A, a top view illustrating the aerodynamic interaction between spargers 42*a–b* of the noise abatement device 46 is shown. As previously discussed, interaction and recombination of the high velocity fluid jets can produce substantial aerodynamic noise. FIG. 5A illustrates an interaction zone 60 that exists between the typical spargers 42*a–b* where the high velocity fluid jets collide and create aerodynamic noise containing low frequency components. As the bypass steam 34 and spray water 33 are driven through the spargers 42*a–b*, radial flow 62 of the fluids causes the fluid jets to recombine at the interaction zone 60 creating substantial aerodynamic noise. FIG. 5B is a side view illustrating the interaction zone 60 occurring along the entire length of the noise abatement device 46. The interaction zone 60 only occurs where the fluid jets combine. Away from the interaction zone 60 of the spargers 42*a–b*, the fluid jets 64 are relatively free to dissipate.

Figure 6:
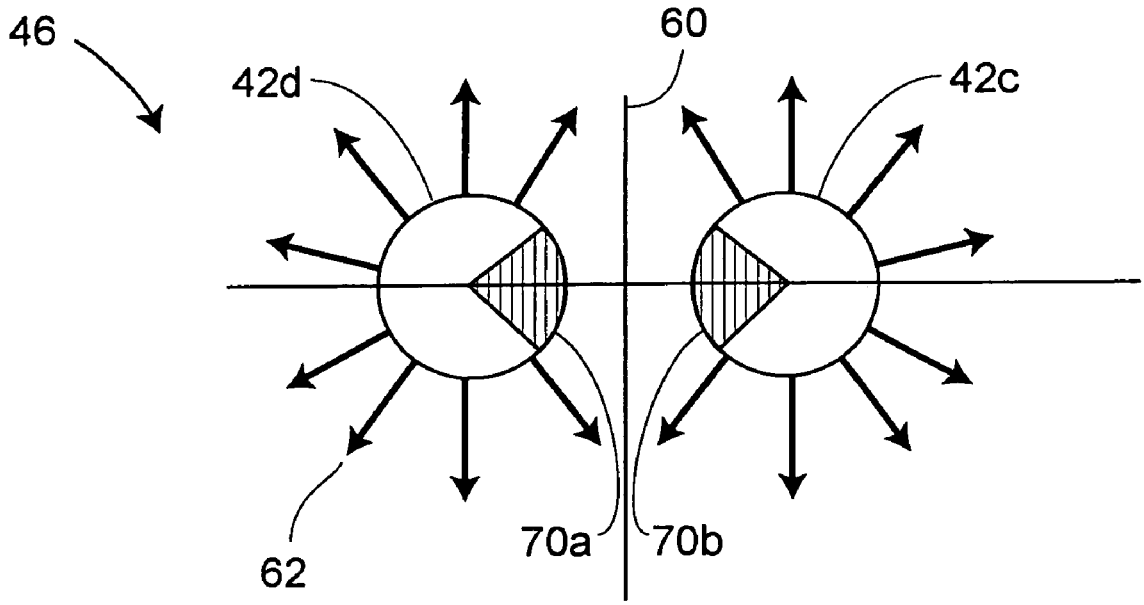
FIG. 6 is an illustrative top view of the present noise abatement device employing parallel spargers with sector blocking to substantially eliminate the fluidic interaction caused by converging radial flow between spargers.

FIG. 6 illustrates a top view of a flow diagram of the preferred noise abatement device 46 having two spargers 42*c–d*. To eliminate the interaction zone 60 between parallel spargers 42*c–d*, a sector of each sparger is designed to prohibit the radial flow 62 from establishing the interaction zone 60 (reference FIGS. 5A and 5B). The top view in FIG. 6 depicts how the blocked sectors 70*a* and 70*b* are placed in approximate mirrored opposition between the spargers 42*c–d*. The sector length of the blocked sectors 70*a* and 70*b* is dependent upon the fluid properties and physical constraints of the condenser duct in which they will be placed. The sector angle, which defines the sector length, is application specific. As claimed, the present noise abatement device has a sector angle in the range of approximately 10 degrees to 90 degrees. For example, if the space-to-diameter ratio of the spargers is approximately 5:1, the preferable sector angle is approximately 45 degrees. By prohibiting radial flow between the parallel spargers 42*c–d*, the interaction zone 60 does not develop, thus the noise abatement device 46 substantially eliminates the potential of jet recombination and substantially eliminates the aerodynamic noise associated with that phenomena. Those skilled in the art can appreciate that sector blocking can be further extended to multiple regions within a single sparger without departing from the spirit and scope of the present noise abatement device. For example, a noise abatement device employing three spargers in a collinear arrangement would require the central sparger to use two diametrically opposed blocking sectors to prohibit interacting flow from the adjacent spargers. Further, the sector blocking technique can be used to prevent fluid flow from impinging on any structures immediately adjacent to the sparger. Several embodiments of the spargers 42*c–d* will now be explained in detail.

Figure 7:
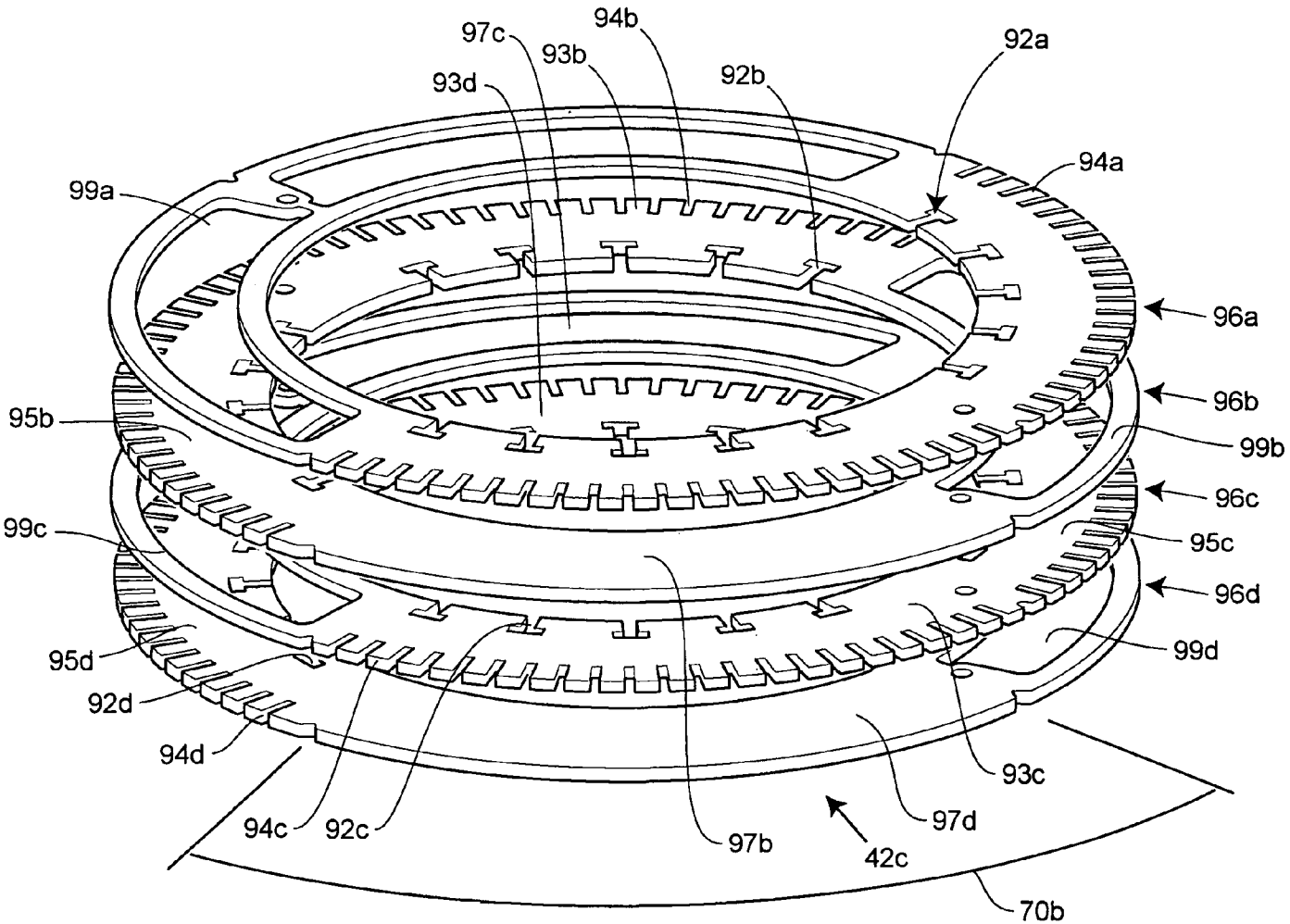
FIG. 7 is an illustrative perspective view of a sparger comprised of a plurality of alternating stacked disks with sector blocking achieved by prohibiting fluid flow through the alternating flow disks.

The present noise abatement device 46 is best appreciated with a brief discussion of fluid pressure reduction techniques employed within the spargers 42*c–d*. The primary function of spargers 42*c–d* is to reduce the steam pressure before it enters the air-cooled condenser. As is known, the Bernoulli Principle summarizes a phenomena in fluid science that dictates that as fluid's velocity is increased, the fluid's pressure is correspondingly decreased. As shown in FIG. 7, the sparger is generally comprised of a stack of annular disks with inlet slots 92*a–d*, outlet slots 96*a–d*, and interconnecting plenums 99*a–d*. By selectively orienting the disks, a series of passageways is created.

During operation, fluid enters the spargers 42*c–d* through the inlets slots 92*a–d* in the hollow center and flows through the passageways created by the interconnecting plenums 99*a–d*. The restrictive nature of the passageways accelerates the fluid as it moves through them. The plenums create fluid chambers within the individual layers of the stacked disks and connect the inlet slots 92*a–d* to the outlet slots 96*a–d*. The flow path geometry created within the sparger produces staged pressure drops by subdividing the flow stream into smaller portions to reduce fluid pressure. In one embodiment, the disk stack contains four similar disks uniquely oriented to create a blocked sector 70*b* as illustrated in FIG. 6 and discussed in greater detail below. The total number of disks used in each sparger is dependent upon the fluid properties and the physical constraints of the application in which the spargers 42*c–d* will be placed. A detailed view of the present sparger 42*c* shows that it is comprised of flow disks 96*a* and 96*c* and blocking disks 96*b* and 96*d*. Fluid is admitted into the sparger 42*c* through passageways created by the flow disks 96*a* and 96*c* and the blocking disks 96*b* and 96*d*. The flow disk 96*c* is divided into two flow sectors 93*c* and 95*c* and two plenum sectors 97*c* and 99*c*. The flow sectors 93*c* and 95*c* have a plurality of inlet slots 92*c* partially extending outward from the hollow center of the disk and a plurality of outlet slots 94*c* partially extending inward from the external perimeter of the disk. The plenum sectors 97*c* and 99*c* in flow disk 96*c* create an internal fluid passageway to connect the inlet slots 92*b* and 92*d* to the outlet slots 94*b* and 94*d* from adjacent flow disks 96*b* and 96*d*. As illustrated, the flow sectors and the plenum sectors are symmetrically placed about of both types of disks. By properly orienting the flow sectors and the plenum sectors as shown and claimed, the desired flow geometry can be achieved.

As previously explained, subdividing the fluid flow into progressively smaller and more numerous flow paths reduces the fluid energy and assists in preventing vibration and substantially reducing aerodynamic noise. In the preferred embodiment, the ratio of outlet slots to inlet slots is approximately four-to-one. Those skilled in the art recognize that deviations from the outlet slot to inlet slot ratio can be made without parting from the spirit and scope of the present noise abatement device.

Continuing, the blocking disks 96*b* and 96*d* are comprised of two flow sectors, one plenum sector, and one blocking sector. The flow sectors 93*b*, 95*b*, 93*d*, and 95*d* and the plenum sectors 99*b* and 99*d* depicted in the blocking disk 96*b* and 96*d* are generally equivalent amongst both disk types. The blocking sectors 97*b* and 97*d* of the blocking disks 96*b* and 96*d* prohibit fluid flow between the adjacent inlet slots 92*a* and 92*c* and the adjacent outlet slots 94*a* and 94*c* by eliminating the plenum sector. As illustrated, the arrangement of the flow and blocking disks will prohibit the formation of the interaction zone between multiple spargers, thus substantially reducing the structural vibration and aerodynamic noise generated within the condenser duct 38.

Consequently, it should be understood that based upon a specific fluid properties and physical design constraints, a sparger can be designed to prohibit flow through any region defined by the position and size of the blocking sector. It can further be appreciated by those skilled in the art that the blocking regions are not only limited to the plenum sectors. Fluid flow can be prohibited by eliminating either the inlets slots, the outlet slots, or combinations of both without departing from the spirit and scope of the present noise abatement device. A solid top disk and a mounting plate (neither being shown) are attached to the top surface and bottom surface of the sparger 42*c* to direct fluid flow through the sparger 42*c* and provide mounting arrangements within the condenser duct 38, respectively.

Figure 8:
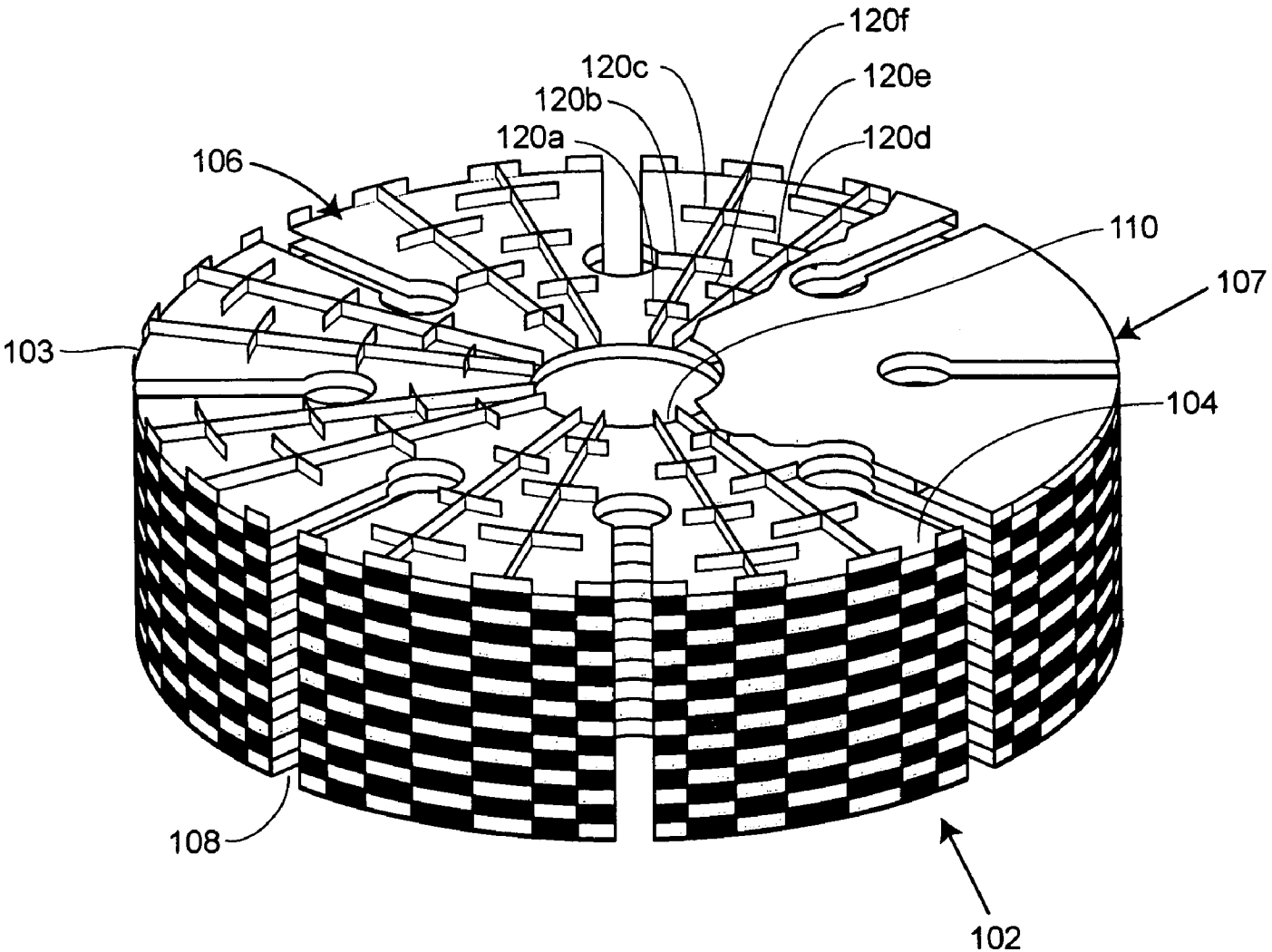
FIG. 8 is an illustrative perspective view of a sparger comprised of a plurality of stacked disks with sector blocking achieved by eliminating the torturous fluidic path through a section of each disk.

Although the preferred embodiment teaches a noise abatement device using spargers designed about alternating disks, other embodiments are conceivable. For example, a tortuous flow path could be created using one or more disks where the tortuous flow paths connect the fluid inlet slots at the hollow center to the fluid outlet slots at the disk perimeter. U.S. Pat. No. 6,095,196, which is hereby incorporated for reference, shows, for example, a stacked disk creating a tortuous flow path using one disk. An illustrative perspective view of an alternate embodiment a sparger provided with a single disk of the present noise abatement device using tortuous paths with a blocked sector is depicted in FIG. 8.

The tortuous path sparger 102 is comprised of a plurality of flow disks 103. The flow disk 103 contains a flow sector 106 and a blocking sector 107. In the flow sector 106, fluid obstructers 120*a*–120*f* positioned on the surface of the flow disk 103 create tortuous passageways that become progressively more restrictive. As previously explained, fluidic restrictions increase fluid velocity and consequently produce a corresponding decrease in fluid pressure. Therefore, the velocity of the fluid entering the tortuous paths 104 of the sparger 102 through inlet slots 110 of flow sector 106 increases as the fluid progresses towards at the fluid outlet slots 108. The fluid pressure is dramatically reduced as the fluid exits the fluid outlet slots 108 and proceeds to the air-cooled condenser 16. Additionally, the flow disk 103 contains a blocking sector 107. The blocking sector 107 prohibits flow by eliminating fluid passageways through a specified region within the flow disk 103. Therefore, a noise abatement device created with spargers using the flow disks presently described will substantially reduce the radial flow between the spargers thereby reducing the damaging effects of the vibration and noise associated with typical spargers. Moreover, the sector-blocking concept described in the previous embodiments can also be applied to a typical sparger to achieve the benefits as claimed.

Figure 9:
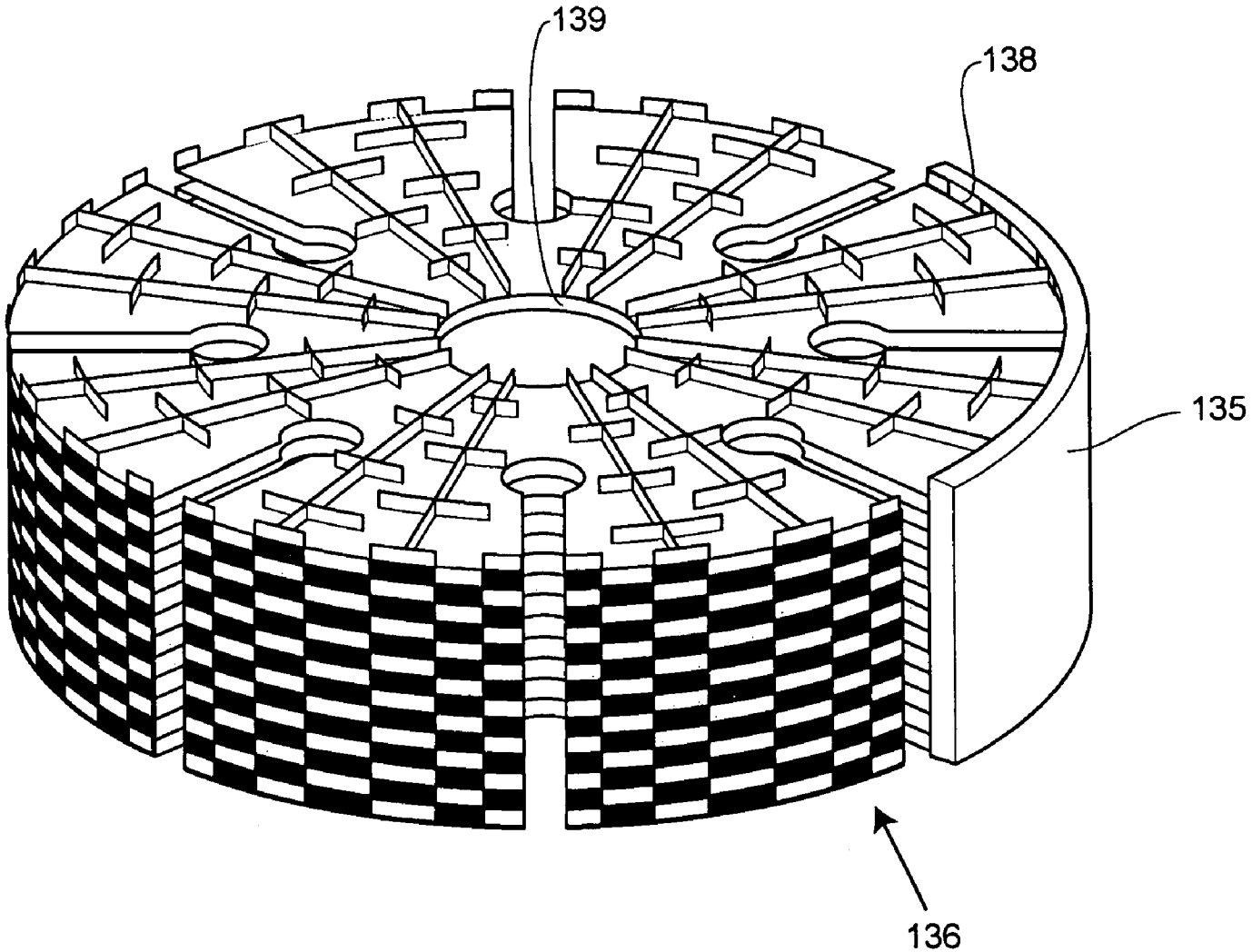
FIG. 9 is an illustrative perspective view of a sector blocking shield attached to the surface of a typical sparger to substantially eliminate the fluidic interaction caused by converging radial flow.

FIG. 9 depicts an improved sparger 136 comprised of a sector blocking shield 135 that can be retrofitted to any typical sparger 42*a*. The sparger 136 of FIG. 9 is illustrated with the tortuous fluid pressure device as described above. The sector blocking shield 135 substantially eliminates the radial flow between a plurality of spargers by directing exit flow from the sparger 136 away from the interaction zone through a sector defined by the length of the sector blocking shield 135. The sector blocking shield 135 is adapted to conform to the outer surface 138 of the sparger 136 and is intimately attached thereon. As understood, the sector blocking shield 135 can be further adapted to conform to the inner surface 139 of the hollow center to achieve similar flow prohibition.

The foregoing detailed description has been given for clearness of understanding only, and no unnecessary limitations should be understood therefrom, as modifications will be obvious to those skilled in the art. For example, the sparger can be constructed from a continuous hollow cylinder with direct radial fluid passageways. The cylinder would again be subdivided into two flow regions wherein the blocking region would have an absence of direct radial passageways to direct flow away from the interaction zone and substantially eliminate the interaction flow between multiple spargers. Additionally, the spargers can be designed to direct flow through any shape flow region defining by the position and size of the blocking sector. The spargers described above create a blocked sector that has uniform length with respect to the longitudinal axis. That is, the width of the blocked sector is equivalent in all the flow disks and is symmetrically aligned. It can further be appreciated by those skilled in the art that length of blocking sectors is not limited to the uniform configuration detailed herein, but could be modified with varying the sector length along the longitudinal axis of the sparger without departing from the spirit and scope of the present sparger and noise abatement device. It can also be appreciated by those skilled in the art that is some cases, the noise abatement device may be created using a single sparger.

What is claimed is:

1. A method of reducing aerodynamic noise and structural vibrations in turbine bypass applications for an air-cooled condensing system, the method comprising the steps of:

fashioning a noise abatement device with at least two spargers, the spargers being positioned substantially parallel to each other and placed in fluid communication with a fluid source, mounting the noise abatement device within a condenser duct, the noise abatement device being generally symmetrically situated within the condenser duct; and, directing the fluid from the fluid source in a predetermined manner through the sparger to substantially reduce the aerodynamic noise and structural vibrations that would otherwise be generated by the fluid exiting the spargers.

2. The method of claim 1, wherein directing fluid in a predetermined manner is comprised of:

separating each of the spargers into at least two regions, the first region containing a plurality of fluid passageways in fluid communication with a plurality of inlets at a hollow center and a plurality of exterior outlets of each sparger wherein the passageways substantially reduce the fluid pressure between the plurality of inlets and outlets, and creating a blocking sector to direct fluid through each sparger to substantially reduce the interactive flow typically generated by the fluid exiting the outlets.

3. A sparger comprised of:

a housing having a hollow center extending along its longitudinal axis containing a plurality of fluid passageways in fluid communication with a plurality of inlets at the hollow center and a plurality of exterior outlets wherein the passageways substantially reduce the fluid pressure between the plurality of inlets and outlets, and a blocking sector to direct fluid in a predetermined manner through the sparger to substantially reduce the interactive flow that would otherwise be generated by the fluid exiting the outlets wherein the sparger is comprised of a plurality of stacked disks.

4. The sparger of claim 3, wherein the plurality of stacked disks includes alternating first and second disks, the first disk containing the first and second regions, the first region being divided between the disk perimeter and the disk hollow center with a fluid inlet stage containing slots partially extending from the disk hollow center towards the disk perimeter and a fluid outlet stage containing slots partially extending from the disk perimeter towards the disk hollow center, and the second region being undivided between the disk perimeter and the disk hollow center; and, the second disk having at least one plenum slot extending through the disk;

wherein the disks are selectively positioned in the stack to direct fluid flow only through the first region of the first disk, the fluid inlet stage slots of the first region in one first disk aligned to the plenum slots in adjacent second disks and to the fluid outlet stage slots in at least one first disk, wherein the fluid flow path is split into two initial axial directions, then into the plenum slots with multiple radial flow directions, and then distributed through multiple outlet stage slots in at least one first disk.

5. The sparger of claim 3, wherein the plurality of stacked disks includes alternating first and second disks, the first disk being divided between the disk perimeter and the disk center with a fluid inlet stage containing slots partially extending from the disk hollow center towards the disk perimeter and a fluid outlet stage containing slots partially extending from the disk perimeter towards the disk hollow center; and, the second disk containing the first and second regions, a first region having at least one plenum slot extending through the disk, and a second region being undivided and continuous;

wherein the disks are selectively positioned in the stack to enable fluid flow through the first region and direct fluid flow away from the second continuous region, the fluid inlet stage slots of one first disk aligned to the plenum slots in the first region of the adjacent second disks and to the fluid outlet stage slots in at least one first disk, so that the fluid flow path is split into two initial axial directions, then into the plenum slots of the first region with multiple radial flow directions, and then distributed through multiple outlet stage slots in at least one first disk.

6. The sparger of claim 3, wherein each disk in the plurality of stacked disks is separated into at least two regions, a first region being divided between the disk perimeter and the disk hollow center with a plurality of respective fluid flow passages extending from a passage inlet at the disk hollow center to a passage outlet for the outlet flow at the disk perimeter, and a second region being undivided and continuous to prohibit fluid flow between the disk hollow center and the disk perimeter wherein each respective fluid flow passage of the first flow region having a tortuous flow path with each tortuous flow path remaining independent from each other in traversing through the disk to substantially avoid collisions between respective tortuous flow paths; and, wherein the fluid flow passages including directed flow paths means at the passage outlets directing the outlet flows to substantially avoid collisions between respective outlet flows on exiting from the respective passage outlets.

7. The sparger of claim 3, wherein the blocked sector is defined by a blocking shield placed in intimate contact with the sparger.

8. A noise abatement device for turbine bypass in air-cooled condensers comprised of:

at least one sparger, the sparger having a hollow center extending along its longitudinal axis containing a plurality of fluid passageways in fluid communication with a plurality of inlets at the hollow center and a plurality of exterior outlets wherein the passageways substantially reduce the fluid pressure between the plurality of inlets and outlets, and a blocking sector to direct fluid in a predetermined manner through the sparger to substantially reduce the aerodynamic noise and structural vibrations that would otherwise be generated by the fluid exiting the sparger, the spargers being positioned approximately parallel to their respective longitudinal axis and symmetrically positioned about a central axis of the noise abatement device.

9. The sparger of claim 8, wherein each sparger is comprised of a plurality of stacked disks.

10. The sparger of claim 9, wherein the plurality of stacked disks includes alternating first and second disks, the first disk containing the first and second regions, the first region being divided between the disk perimeter and the disk hollow center with a fluid inlet stage containing slots partially extending from the disk hollow center towards the disk perimeter and a fluid outlet stage containing slots partially extending from the disk perimeter towards the disk hollow center, and the second region being undivided and continuous between the disk perimeter and the disk hollow center; and, the second disk having at least one plenum slot extending through the disk;

wherein the disks being selectively positioned in the stack to direct fluid flow only through the first region of the first disk, the fluid inlet stage slots of the first region in one first disk aligned to the plenum slots in adjacent second disks and to the fluid outlet stage slots in at least one first disk, wherein the fluid flow path is split into two initial axial directions, then into the plenum slots with multiple radial flow directions, and then distributed through multiple outlet stage slots in at least one first disk.

11. The sparger of claim 9, wherein the plurality of stacked disks includes alternating first and second disks, the first disk being divided between the disk perimeter and the disk center with a fluid inlet stage containing slots partially extending from the disk hollow center towards the disk perimeter and a fluid outlet stage containing slots partially extending from the disk perimeter towards the disk hollow center; and, the second disk containing the first and second regions, a first region having at least one plenum slot extending through the disk, and a second region undivided and continuous;

wherein the disks being selectively positioned in the stack to enable fluid flow through the first region and direct fluid flow away from the second region, the fluid inlet stage slots of one first disk aligned to the plenum slots in the first region of the adjacent second disks and to the fluid outlet stage slots in at least one first disk, wherein the fluid flow path is split into two initial axial directions, then into the plenum slots of the first region with multiple radial flow directions, and then distributed through multiple outlet stage slots in at least one first disk.

12. The sparger of claim 9, wherein each disk in the plurality of stacked disks is separated in to at least two regions, a first region being divided between the disk perimeter and the disk hollow center with a plurality of respective fluid flow passages extending from a passage inlet at the disk hollow center to a passage outlet for the outlet flow at the disk perimeter, and a second region being undivided to prohibit fluid flow between the disk hollow center and the disk perimeter;

wherein each respective fluid flow passage of the first flow region having a tortuous flow path with each tortuous flow path remaining independent from each other in traversing through the disk to substantially avoid collisions between respective tortuous flow paths; and, wherein the fluid flow passages including directed flow paths means at the passage outlets directing the outlet flows to substantially avoid collisions between respective outlet flows on exiting from the respective passage outlets.

13. The sparger of claim 8, wherein the blocked sector is defined by a blocking shield placed in intimate contact with the sparger.

* * * * *

UNITED STATES PATENT AND TRADEMARK OFFICE

CERTIFICATE OF CORRECTION

PATENT NO. : 7,055,324 B2
APPLICATION NO. : 10/387145
DATED : June 6, 2006
INVENTOR(S) : Charles L. DePenning et al.

It is certified that error appears in the above-identified patent and that said Letters Patent is hereby corrected as shown below:

On the First Page:

At field (74), "Gerstein Borun" should be -- Gerstein & Borun --.

In the Specification:

At Column 3, line 22, "view the" should be -- view of the --.

At Column 3, line 25, "view the" should be -- view of the --.

At Column 3, line 28, "view the" should be -- view of the --.

At Column 4, line 30, "shutdown" should be -- shut down --.

At Column 4, line 58, "valve" should be -- valves --.

At Column 6, line 10, "envision" should be -- envisioned --.

At Column 10, line 18, "that is some" should be -- that in some --.

Signed and Sealed this

Twenty-third Day of March, 2010

David J. Kappos

David J. Kappos
*Director of the United States Patent and Trademark Office*